US007106155B2

(12) United States Patent
Turner et al.

(10) Patent No.: US 7,106,155 B2
(45) Date of Patent: Sep. 12, 2006

(54) DOUBLE-LEVER MECHANISM, TRIP ACTUATOR ASSEMBLY AND ELECTRICAL SWITCHING APPARATUS EMPLOYING THE SAME

(75) Inventors: David C. Turner, Imperial, PA (US); Louis F. Grahor, Allison Park, PA (US); Jason K. McMains, Akron, OH (US); Thomas M. Whalen, Cranberry Township, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/019,039

(22) Filed: Dec. 21, 2004

(65) Prior Publication Data

US 2006/0132270 A1 Jun. 22, 2006

(51) Int. Cl.
*H01H 67/02* (2006.01)

(52) U.S. Cl. ..... 335/132; 335/172

(58) Field of Classification Search ..... 335/132
See application file for complete search history.

(56) References Cited

U.S. PATENT DOCUMENTS 4,679,019 A 7/1987 Todaro et al.
4,801,907 A * 1/1989 Kelaita et al. ..... 335/20
5,093,643 A * 3/1992 Altenhof et al. ..... 335/20
5,302,786 A * 4/1994 Rosen et al. ..... 200/400
5,343,179 A * 8/1994 Pipich et al. ..... 335/167
6,211,757 B1 4/2001 Castonguay et al.
6,366,188 B1 * 4/2002 Hein et al. ..... 335/202
6,441,708 B1 * 8/2002 Rodriguez et al. ..... 335/172
6,600,396 B1 * 7/2003 Rodriguez et al. ..... 335/132
6,700,082 B1 3/2004 Gibson et al.

* cited by examiner

*Primary Examiner*—Lincoln Donovan
(74) *Attorney, Agent, or Firm*—Martin J. Moran

(57) ABSTRACT

A double-lever mechanism is for the trip actuator of a circuit breaker having a housing, separable contacts and an operating member for opening and closing the contacts. A trip bar opens the separable contacts in response to a trip condition, such as an overcurrent condition. The trip actuator assembly is a self-contained unit including an actuation subassembly comprising the double-lever mechanism and a coil and a plunger housed within an enclosure. First and second trip levers of the double-lever mechanism are pivotally coupled to first and second ends of the enclosure, respectively. In response to the trip condition, the plunger extends, pivoting the first trip lever which engages and pivots the second trip lever in order to actuate the trip bar. The double-lever mechanism provides a mechanical advantage by reducing actuating forces and plunger travel.

6 Claims, 5 Drawing Sheets

50

DOUBLE-LEVER MECHANISM, TRIP ACTUATOR ASSEMBLY AND ELECTRICAL SWITCHING APPARATUS EMPLOYING THE SAME

BACKGROUND OF THE INVENTION

1. Field of the Invention

The present invention relates generally to electrical switching apparatus and, more particularly, to a double-lever mechanism for the trip actuator of a circuit breaker. The invention also relates to trip actuator assemblies having double-lever mechanisms and to circuit breakers with trip actuators employing double-lever mechanisms.

2. Background Information

Electrical switching apparatus, such as molded case circuit breakers, generally include at least one pair of separable contacts which are operated either manually, by way of a handle disposed on the outside of the case, or automatically by way of a trip unit in response to an overcurrent condition, such as an overload condition or a relatively high level short circuit or fault condition.

One type of molded case circuit breaker trip unit, known as a Flux Transfer Shunt Trip (FTST) unit 2, is shown in FIG. 1. Trip units such as the FTST unit 2 generally include an enclosure 4 housing a coil and plunger assembly 6. The coil and plunger assembly 6 includes a coil 8 which is energized in preparation for moving a plunger 10. For example, the plunger 10 may be spring-biased, being held against such spring-bias by a pivotal trip lever 12 or, as in the case of the FTST unit 2, the assembly 6 may be electrically charged, with the coil 8 operating to extend the plunger 10 in response to an electrical signal received as the result of the overcurrent condition. The pivotal lever 12 is pivotally connected to the enclosure 4 by a pivot member 14. In response to the overcurrent condition, the trip actuator plunger 10 is fired, or otherwise released, from its biased or charged, unextended position, such that it extends and engages the pivotal trip lever 12 causing it to rotate and engage the trip bar (not shown) of the circuit breaker (not shown). The circuit breaker trip bar then rotates thereby tripping open the circuit breaker separable contacts (not shown).

As shown, the pivotal trip lever 12 is relatively short with the distance between the pivot 14 at one end of the lever 12 and the other end of the lever 12, at which point the plunger 10 acts upon the lever 12, being relatively small. Such a design is mechanically inefficient, requiring a larger coil and plunger assembly 6 than necessary, in order to provide the requisite force and plunger stroke to engage and actuate the circuit breaker trip bar.

In view of the foregoing, it is desirable to provide a trip actuator assembly which is more efficient, requiring less force to actuate and thus reducing the size of the coil and plunger assembly components necessary to effectuate such force. It is also desirable that the improved trip actuator assembly be readily interchangeable with a variety of electrical switching apparatus, including molded case circuit breakers.

There is, therefore, room for improvement in trip actuator mechanisms for circuit breakers and in circuit breakers employing trip actuator mechanisms.

SUMMARY OF THE INVENTION

These needs and others are satisfied by the present invention, which is directed to a double-lever trip actuator mechanism for the trip actuator of a circuit breaker. Unlike known prior art trip actuators which employ one lever, the present invention employs a two-lever design to utilize mechanical advantage (e.g., lever principles) in order to require less actuating force and plunger travel compared to previous single-lever mechanisms. The double-lever trip actuator mechanism can also be used interchangeably with a wide variety of circuit breaker frames.

As one aspect of the invention, a double-lever mechanism is for a trip actuator of an electrical switching apparatus. The electrical switching apparatus includes a trip bar. The trip actuator includes a coil and a plunger for actuating the trip bar in response to a trip condition. The double-lever mechanism comprises: an enclosure structured to house the coil and the plunger, the enclosure including a first end and a second end; a first trip lever pivotally coupled to the first end of the enclosure; and a second trip lever pivotally coupled to the second end of the enclosure opposite the first end, the second trip lever structured to engage and actuate the trip bar in order to trip the electrical switching apparatus. The first trip lever pivots and engages the second trip lever which pivots in order to actuate the trip bar when the first trip lever is engaged and pivoted by the plunger in response to the trip condition.

The double-lever mechanism is structured to provide a mechanical advantage by decreasing the actuating force required to actuate the trip bar and trip the electrical switching apparatus.

As another aspect of the invention, a trip actuator assembly is for an electrical switching apparatus including a housing enclosing separable contacts and an operating mechanism for opening and closing the separable contacts. The operating mechanism includes a trip bar operable between a first tripped position and a second non-tripped position. The trip actuator assembly comprises: an enclosure; a plurality of interacting tripping elements coupled to the enclosure, one of the tripping elements being structured to engage and actuate the trip bar in order to trip the electrical switching apparatus; and an actuation subassembly housed within the enclosure and adapted to actuate the interacting tripping elements in response to a trip condition.

The actuation subassembly may include a coil and a plunger wherein the coil is adapted to extend the plunger thereby actuating the interacting trip elements in response to the trip condition. The interacting trip elements may include two interacting trip elements wherein the plunger engages a first one of the interacting tripping elements and the first one of the interacting tripping elements is structured to interact with a second one of the interacting elements in order to pivot the second one and actuate the trip bar.

The interacting tripping elements may be a double-lever mechanism comprising: a first trip lever pivotally coupled to the enclosure at a first location, and a second trip lever pivotally coupled to the enclosure at a second location, wherein the first trip lever is structured to pivot and engage the second trip lever in response to being engaged by the plunger, thereby causing the second trip lever to pivot and actuate the trip bar of the electrical switching apparatus. The double-lever mechanism may be structured to provide a mechanical advantage by decreasing the actuating force required to actuate the trip bar and trip the electrical switching apparatus.

The enclosure, the interacting trip elements and the actuating subassembly may form a self-contained, removable unit which is structured to be removably coupled within the housing of the electrical switching apparatus.

As another aspect of the invention, an electrical switching apparatus comprises: a housing; separable contacts housed within the housing; an operating mechanism structured to open and close the separable contacts, the operating mechanism including a trip bar operable between a first tripped position and a second non-tripped position; and a trip actuator assembly comprising: an enclosure; a plurality of interacting tripping elements coupled to the enclosure, one of the tripping elements engaging and actuating the trip bar in order to trip the electrical switching apparatus; and an actuation subassembly housed within the enclosure and adapted to actuate the interacting tripping elements in response to a trip condition.

The actuation subassembly may include a coil and a plunger wherein the coil extends the plunger thereby actuating the interacting trip elements in response to the trip condition. The plunger may engage a first one of the interacting tripping elements and the first one of the interacting tripping elements may interact with a second one of the interacting elements in order to pivot the second one and actuate the trip bar.

The interacting tripping elements may be a double-lever mechanism comprising: a first trip lever pivotally coupled to the enclosure at a first location, and a second trip lever pivotally coupled to the enclosure at a second location, wherein the first trip lever pivots and engages the second trip lever in response to being engaged by the plunger, thereby causing the second trip lever to pivot and actuate the trip bar of the electrical switching apparatus. The double-lever mechanism may provide a mechanical advantage by decreasing the actuating force required to actuate the trip bar and trip the electrical switching apparatus.

The electrical switching apparatus may be a circuit breaker including ON and OFF positions corresponding to the separable contacts being closed and open, respectively. The operating mechanism may include a reset mechanism adapted to reset the double-lever mechanism and the plunger when the circuit breaker is transitioned from the ON position toward the OFF position, thereby opening the separable contacts.

The enclosure, the interacting tripping elements and the actuation subassembly may form a self-contained, removable unit which is removably coupled within the housing of the electrical switching apparatus.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
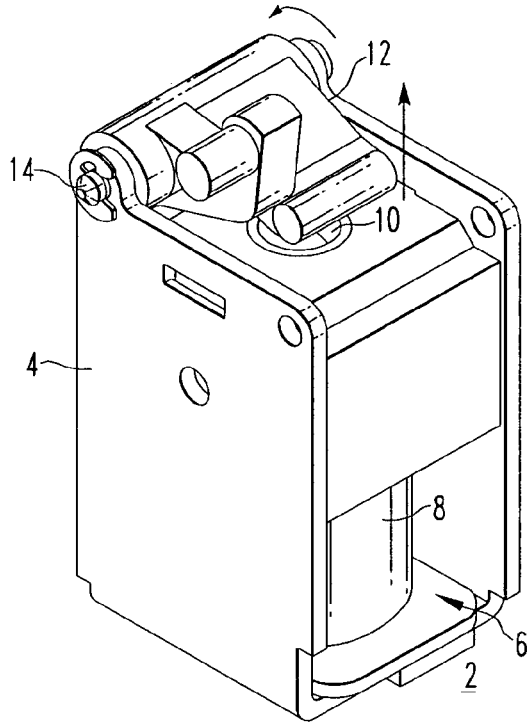
FIG.1 PRIOR ART
FIG. 1 is an isometric view of a single-lever trip actuator assembly for a circuit breaker.

For purposes of illustration, the invention will be described as applied to the trip actuator of a circuit breaker, although it will become apparent that it could also be applied to other types of electrical switching apparatus (e.g., without limitation, circuit switching devices and other circuit interrupters such as contactors, motor starters, motor controllers and other load controllers) having an operating mechanism and an actuator with a pivotal arm therefor.

Directional phrases used herein, such as, for example, left, right, front, back, clockwise, counterclockwise and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "trip condition" refers to any abnormal electrical condition causing a circuit breaker to trip, expressly including, without limitation, an overcurrent condition, an overload condition, an undervoltage condition, or a relatively high level short circuit or fault condition.

Figure 2:
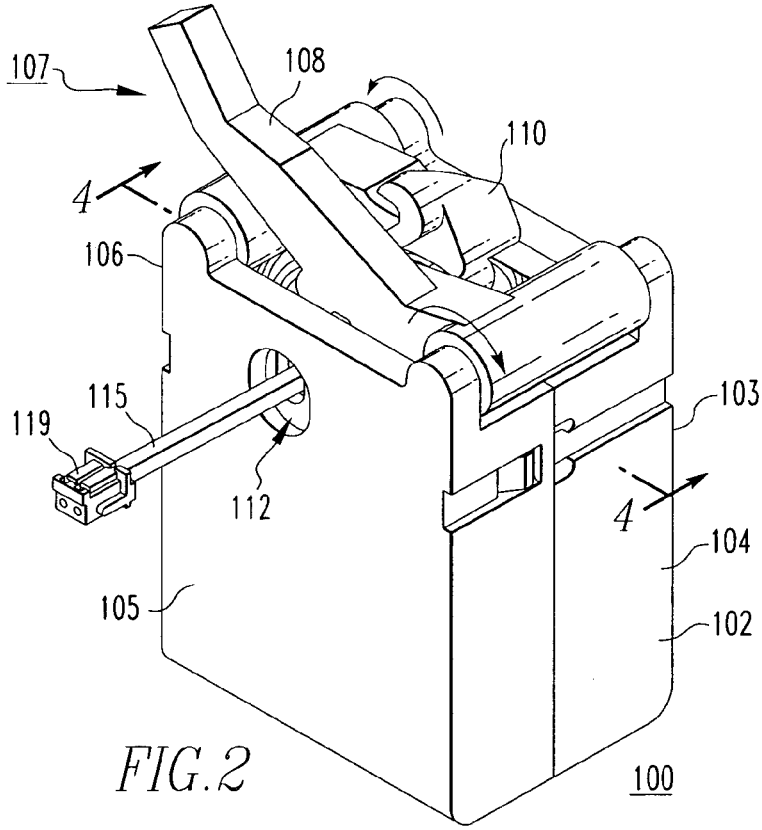
FIG. 2 is an isometric view of one side of a double-lever trip actuator assembly in accordance with the present invention.
Figure 3:
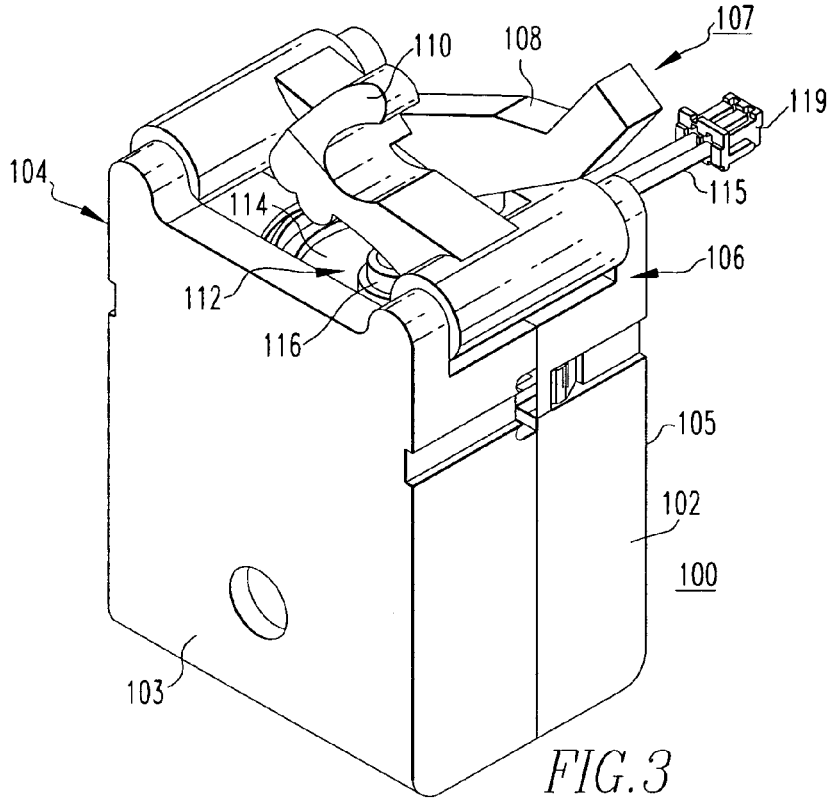
FIG. 3 is an isometric view of the opposite side of the double-lever trip actuator assembly of FIG. 2.
Figure 4:
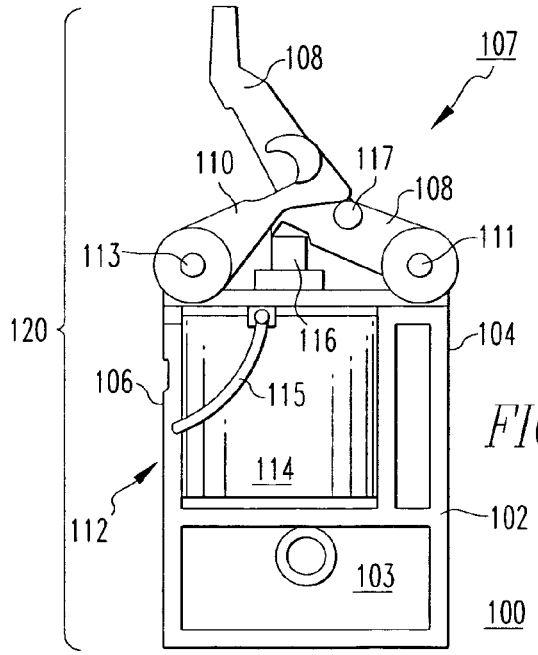
FIG. 4 is a cross-sectional view of the double-lever trip actuator assembly taken along line 4—4 of FIG. 2.
Figure 7:
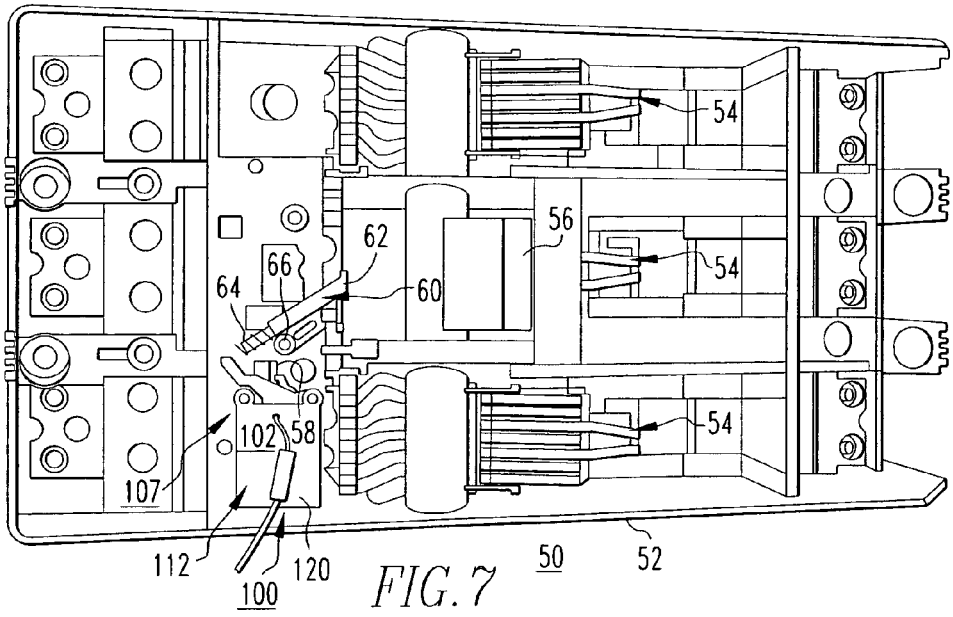
FIG. 7 is a plan view of the assembly of FIG. 5 showing the entire three-pole circuit breaker, with the cover of the circuit breaker removed to show internal structures.

FIGS. 2–4 show a trip actuator assembly 100 for an electrical switching apparatus such as a circuit breaker (see, e.g., 3-pole circuit breaker 50 of FIG. 7). The trip actuator 100 comprises an assembly including an enclosure 102 having first and second ends 104, 106 and first and second sides 103, 105. A plurality of interacting tripping elements, such as the exemplary first and second trip levers 108, 110 of a double-lever mechanism 107, are pivotally coupled to the first and second ends 104, 106 of the enclosure 102, respectively.

As best shown in the cross-sectional view of FIG. 4, the trip actuator assembly 100 includes an actuation subassembly 112 having the double-lever mechanism 107 and a coil 114 and a plunger 116 which are housed within the enclosure 102. The exemplary first and second trip levers 108, 110 are pivotally coupled to the first and second ends 104, 106 of the housing 102 by first and second pivot pins 111, 113. However, it will be appreciated that any suitable alternative pivotal connecting mechanism or fastener (not shown) could be employed. The coil 114 is adapted to extend the plunger 116 thereby actuating the double-lever mechanism 107 in response to a trip condition. Specifically, the coil 114 may be energized by electrical equipment (not shown) within the circuit breaker 50 (FIGS. 5–8) and electrically connected, for example, by a pair of electrical conductors, generally referred to as reference 115 in FIGS. 1–4, and an associated connector 119. When energized, the coil 114 functions to extend the plunger 116 (best shown in FIG. 4) in response to the trip condition. This, in turn, actuates the exemplary double-lever mechanism 107 as will be discussed in further detail herein.

Figure 5:
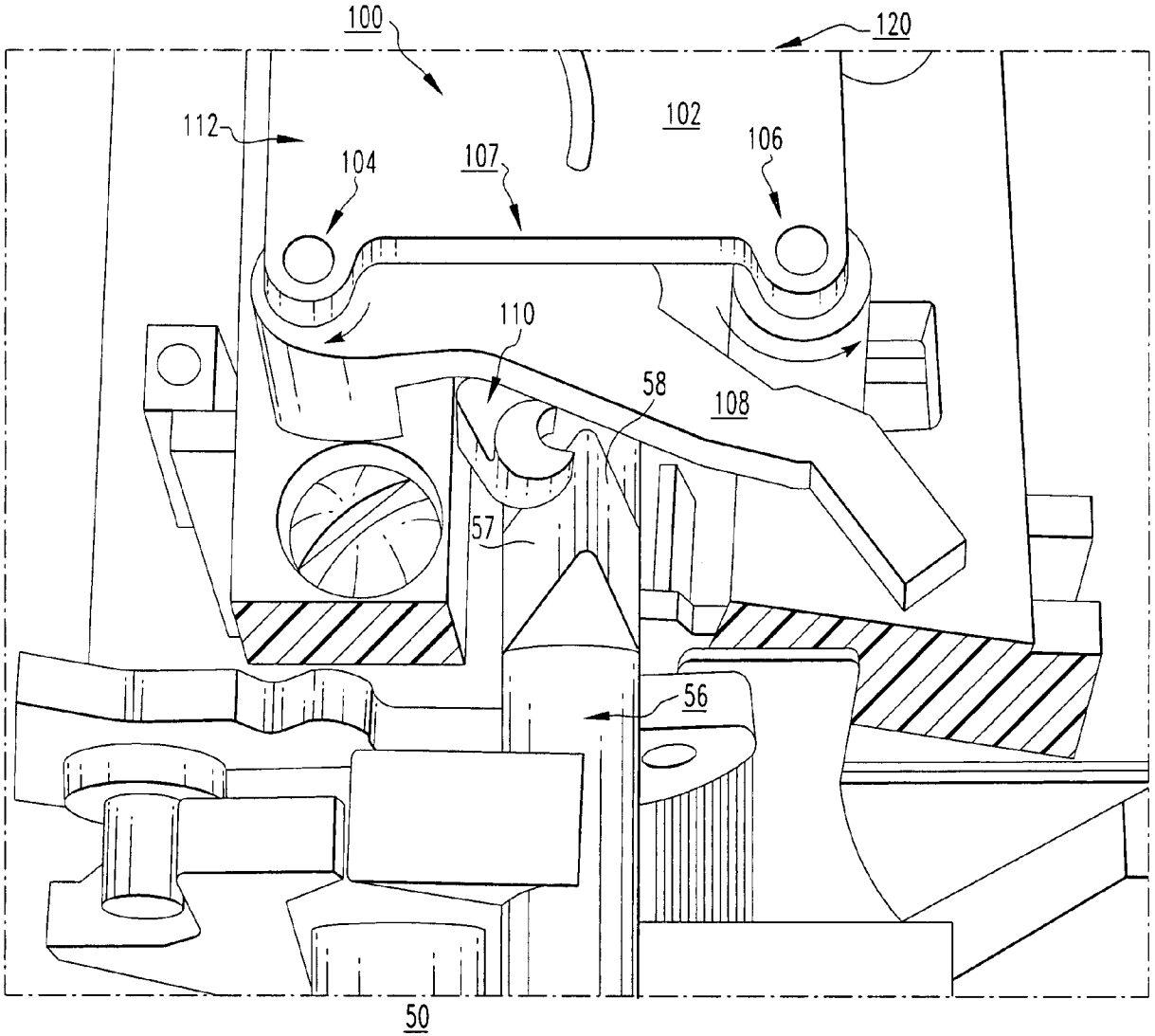
FIG. 5 is an isometric view of the double-lever trip actuator of FIG. 2 as employed within a molded case circuit breaker, shown in the non-tripped position with portions of the circuit breaker cut away to show internal structures.
Figure 6:
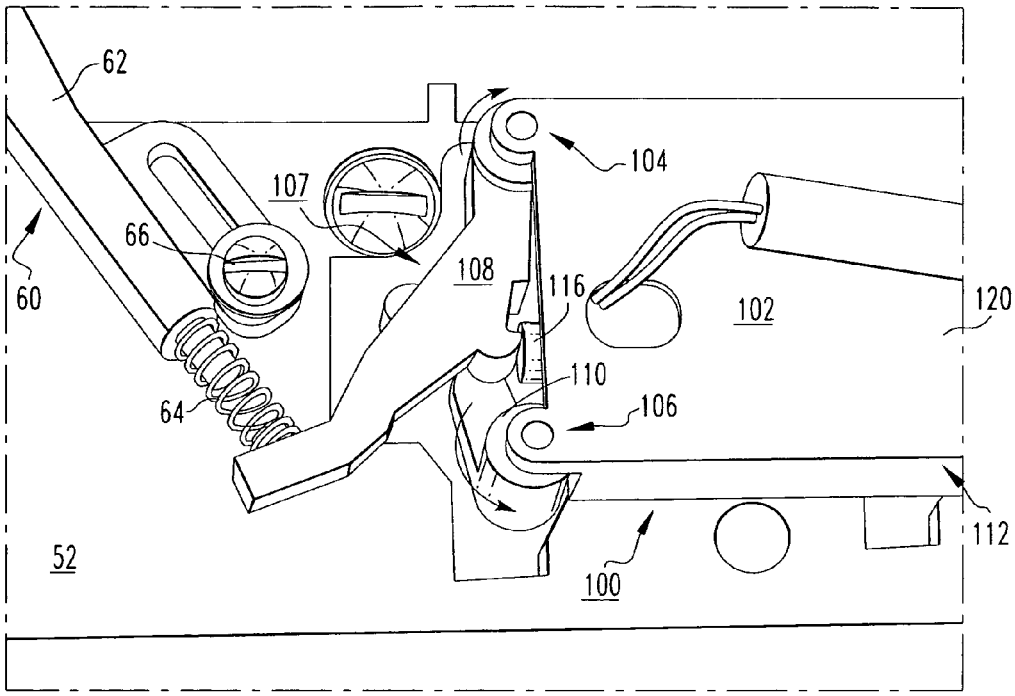
FIG. 6 is a plan view of the double-lever trip actuator of FIG. 5, shown in the tripped position, with the plunger extended thereby pivoting the two trip levers.

FIGS. 5, 6 and 7 show the trip actuator assembly 100 as employed within the circuit breaker, such as the three-pole circuit breaker 50 of FIG. 7. As shown, the three-pole circuit breaker 50 includes a housing 52, separable contacts 54 (FIG. 7) housed within the housing 52, an operating mechanism 56 structured to open and close the separable contacts 54, and the exemplary trip actuator assembly 100. The operating mechanism 56 includes a trip bar 58 which is operable between a first tripped position (not shown) in which the separable contacts 54 (FIG. 7) are tripped open, and a second non-tripped position (FIG. 5).

In operation, when a trip condition occurs, the coil 114 (FIG. 4) is actuated thus extending the plunger 116 (FIG. 6) which engages the first trip lever 108 of the double-lever mechanism 107. The first trip lever 108 engages and interacts with the second trip lever 110, pivoting it in order to pivot and actuate the trip bar 58. More specifically, as shown in FIG. 6, when the plunger 116 extends from the trip actuator housing 102 it engages and pivots first trip lever 108 clockwise about pivot 111 (FIG. 4) at the first end 104 of enclosure 102. The exemplary first pivot lever 108 includes a projection 117 (best shown in FIG. 4). Thus, as the first trip lever 108 is pivoted clockwise by plunger 116, the projection 117 engages and pivots second trip lever 110 counterclockwise about pivot 113 (FIG. 4) at the second end 106 of enclosure 102. The opposite end of the second trip lever 110 then engages and actuates a tab 57 on the end of the trip bar 58 (best shown in FIG. 5) by rotating it clockwise with respect to FIG. 5. In this manner, the trip actuator assembly 100 of the present invention trips open the separable contacts 54 (FIG. 7) in response to the trip condition.

Figure 8:
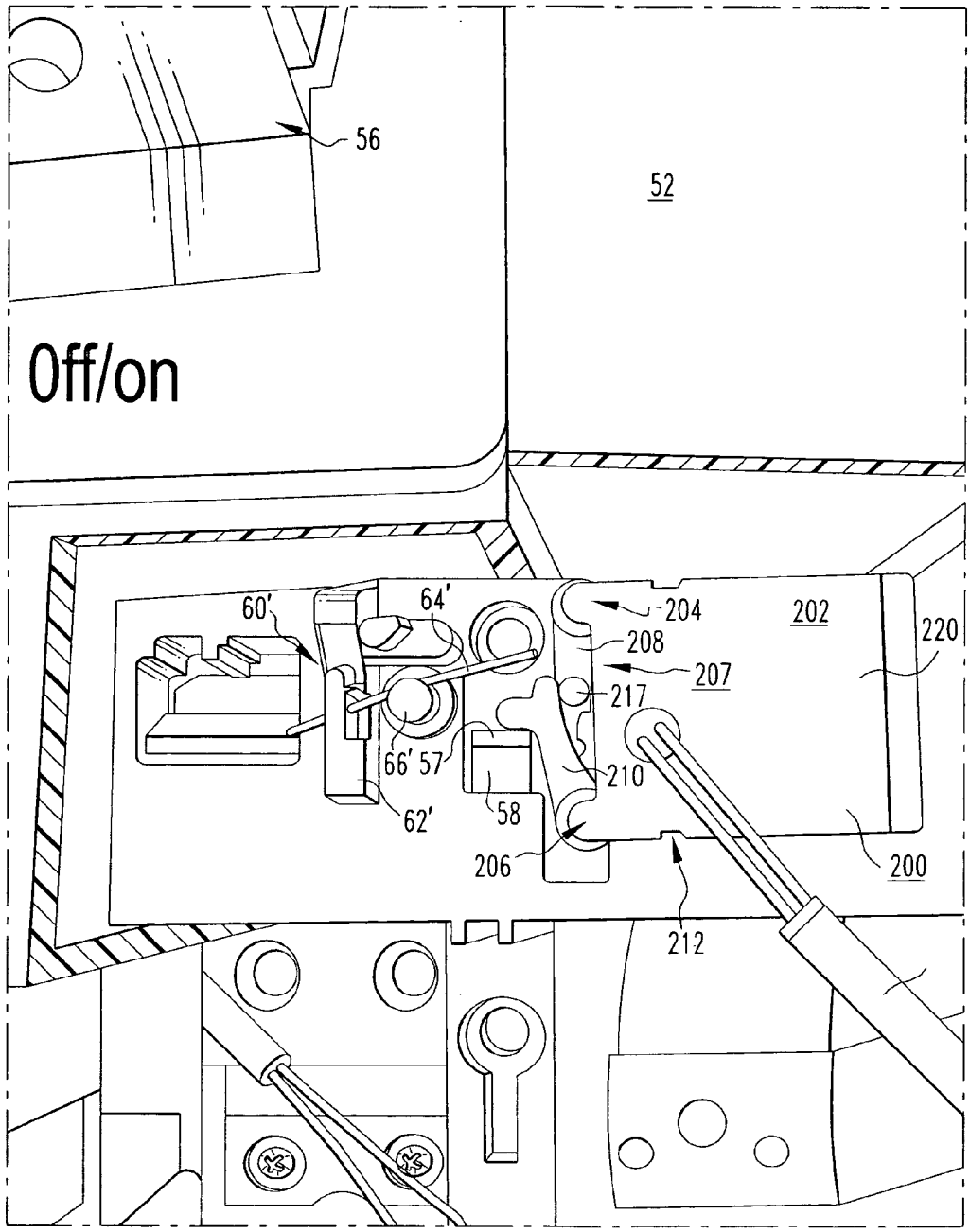
FIG. 8 is a plan view of a double-lever trip actuator assembly in accordance with another embodiment of the invention having a different double-lever configuration as employed within a molded case circuit breaker, shown in the non-tripped position with portions of the circuit breaker housing cut away to show internal structures.

The circuit breaker 50 has ON and OFF positions corresponding to the separable contacts 54 being closed and open, respectively. As shown in FIGS. 6–8, the circuit breaker operating mechanism 56 includes a reset mechanism 60 for resetting the double-lever mechanism 107 and plunger 116 when the circuit breaker 50 is transitioned (e.g., the operating handle 56 is moved) from the ON position towards the OFF position. In the example of FIGS. 6 and 7, the reset mechanism 60 includes a pivotal lever 62 coupled to the circuit breaker housing 52. Although pivotal lever 62 is coupled to the housing using screw 66 inserted through a sleeve (not shown) and engaging the housing 52, it will be appreciated that any suitable fastener (not shown) could alternatively be employed. One end of the pivotal lever 62 is positioned adjacent the operating mechanism 56 (best shown in FIG. 7) of the circuit breaker 50. The opposite end includes a linear spring 64 coupled thereto, as shown. Accordingly, when the operating mechanism 56 is pivoted toward the OFF position, it engages and pivots the pivotal lever 62 which causes the linear spring 64 to compress against and reset the double-lever mechanism 107 and plunger 116. The circuit breaker 50 can then be turned back ON for normal use.

It will be appreciated that the present invention contemplates trip actuators (e.g., 100) having a variety of alternative suitable trip element configurations other than those described and illustrated herein. For example, FIG. 8 illustrates an alternative embodiment of a trip actuator assembly 200 having a different double-lever mechanism 207 configuration and a different reset mechanism 60'. In this embodiment, like components are numbered substantially similarly to the reference numbering of the corresponding components in the previously disclosed embodiments, but under reference characters starting with 200 for the trip actuator assembly and 60' for the reset mechanism. Specifically, the aforementioned trip actuator assembly 200 corresponds to the trip actuator assembly 100 and 60' corresponds to the trip actuator 60 of FIGS. 2–7.

In the example of FIG. 8, rather than the pivotal lever 62 previously discussed, the reset mechanism 60' includes a slidable lever 62' which is slidably coupled to the circuit breaker housing 52 proximate the operating mechanism 56 by fastener 66'. Additionally, the reset mechanism 60' includes a torsional spring 64' coupled to the housing 52 proximate the trip actuator 200, as shown. In this manner, when the operating mechanism 56 is moved toward the OFF position, it engages and slides the slidable lever 62' which engages the torsional spring 64' causing it to compress against and reset the double-lever mechanism 207. The double-lever mechanism 207 functions substantially similar to the aforementioned double-lever mechanism 107 and differs only in having a slightly different shape and configuration, as shown of the first and second trip levers 208, 210. It will be appreciated that a wide variety of alternative tripping element (e.g., 208, 210) configurations could be employed. For example, the tripping elements could be reversed from how they are illustrated and described herein, with the second trip element being engaged and pivoted by the plunger and the first trip element pivoting and actuating the trip bar. It will also be appreciated that more than two tripping elements could be employed.

Accordingly, the present invention provides a trip actuator assembly 100, 200 which defines a self-contained unit 120, 220 interchangeably employable within the housing 52 of a variety of electrical switching apparatus (e.g., three-pole circuit breaker 50 of FIG. 7). The double-lever mechanism 107, 207 provides a mechanical advantage for the trip actuator 100, 200 to engage and actuate the trip bar 58. Specifically, by employing two trip levers 108,110 or 208, 210, relatively less actuating force is required by the coil 114 and plunger 116 of the actuation subassembly 112, when compared with known prior art single-lever trip units (see, e.g., trip unit 2 with one pivotal trip lever 12 of FIG. 1). The cumulative movement of the exemplary counter rotating first and second trip levers 108,110 or 208,210 accomplishes the same function as known prior art single-lever designs, but much more efficiently, because less plunger travel is required. Furthermore, because of the reduced actuating force required, the coil and plunger of the actuation subassembly may be reduced in size in comparison with the coil and plunger required to accomplish the same movement and force using a single lever (see, e.g., coil 8 and plunger 10 of FIG. 1).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical switching apparatus comprising:

a housing;

separable contacts housed within said housing;

an operating mechanism structured to open and close said separable contacts, said operating mechanism including a trip bar operable between a first tripped position and a second non-tripped position;

a trip actuator assembly comprising:

an enclosure, a plurality of interacting tripping elements coupled to said enclosure, one of said tripping elements engaging and actuating said trip bar in order to trip said electrical switching apparatus, an actuation subassembly housed within said enclosure and adapted to actuate said interacting tripping elements in response to a trip condition, including as said interacting tripping elements a double-lever mechanism comprising:

a first trip lever pivotally coupled to said enclosure at a first location, a second trip lever pivotally coupled to said enclosure at a second location, and wherein said first trip lever pivots and engages said second trip lever in response to being engaged by said plunger, thereby causing said second trip lever to pivot and actuate said trip bar of said electrical switching apparatus.

2. The electrical switching apparatus of claim 1 wherein said enclosure includes a first end and a second end; wherein said first trip lever is pivotally coupled to the first end of said enclosure; wherein said second trip lever is pivotally coupled to the second end of said enclosure opposite said first end; and wherein when said plunger engages and pivots said first trip lever, said first trip lever engages and pivots said second trip lever.

3. The electrical switching apparatus of claim 1 wherein an actuating force is required to actuate said trip bar; and wherein said double-lever mechanism provides a mechanical advantage by decreasing said actuating force required to actuate said trip bar and trip said electrical switching apparatus.

4. The electrical switching apparatus of claim 1 wherein said electrical switching apparatus is a circuit breaker; wherein said circuit breaker has ON and OFF positions corresponding to said separable contacts being closed and open, respectively; and wherein said operating mechanism includes a reset mechanism adapted to reset said double-lever mechanism and said plunger when said circuit breaker is transitioned from said ON position toward said OFF position.

5. The electrical switching apparatus of claim 4 wherein said reset mechanism comprises:

a pivotal lever coupled to said housing proximate said operating mechanism thereof;

a linear spring coupled to said pivotal lever, wherein said operating mechanism engages and pivots said pivotal lever when said operating mechanism is pivoted toward said OFF position, which causes said linear spring to compress against and reset said double-lever mechanism.

6. The electrical switching apparatus of claim 4 wherein said reset mechanism comprises:

a slidable lever slidably coupled to said housing proximate said operating mechanism thereof; and a torsional spring coupled to said housing proximate said trip actuator assembly, wherein said operating mechanism engages and slides said slidable lever when said operating mechanism is moved toward the OFF position, and wherein said slidable lever engages said torsional spring causing it to compress against and reset said double-lever mechanism.

* * * * *